United States Patent [19]

Ogilvie et al.

[11] 4,053,701

[45] Oct. 11, 1977

[54] GROMMET ASSEMBLY FOR FURNITURE ARTICLES

[75] Inventors: LeRoy F. Ogilvie, Youngstown; Henry F. Hartig, Poland, both of Ohio

[73] Assignee: GF Business Equipment, Inc., Youngstown, Ohio

[21] Appl. No.: 680,884

[22] Filed: Apr. 27, 1976

[51] Int. Cl.[2] ..... A47B 13/00

[52] U.S. Cl. ..... 174/48; 16/2; 312/223; 108/23

[58] Field of Search ..... 16/2, 108; 312/223; 174/48, 65 R; 108/23

[56] References Cited

U.S. PATENT DOCUMENTS

| | | | |
|---|---|---|---|
| 3,783,175 | 1/1974 | Timmons | 312/223 X |
| 3,787,605 | 1/1974 | Van Gessel et al. | 174/48 |
| 3,873,758 | 3/1975 | Van Gessel et al. | 312/223 X |

FOREIGN PATENT DOCUMENTS

| | | | |
|---|---|---|---|
| 111,887 | 9/1965 | Netherlands | 174/65 R |

*Primary Examiner*—Andrew V. Kundrat
*Attorney, Agent, or Firm*—Emory L. Groff, Jr.

[57] ABSTRACT

A furniture article top includes a grommet assembly providing a restricted wiring access spaced inwardly from the furniture top edge. The grommet assembly includes a stationary segment and a slidably removable segment having a front edge normally positively retained in a use position flush with the adjacent furniture top edge whereby, axial displacement of the slidable segment substantially increases the area of the wiring access.

13 Claims, 8 Drawing Figures

GROMMET ASSEMBLY FOR FURNITURE ARTICLES

This invention relates generally to wiring access means for furniture articles and more particularly to an improved multi-component grommet assembly particularly adapted for installation in the top of a furniture article.

Those skilled in the art of furniture appliances will readily appreciate the need for ready means facilitating the installation and removal of electrical wiring or cables as used in association with furniture articles such as desks and tables. Telephones, typewriters, calculators and lighting equipment are a few of the devices commonly utilized in association with furniture articles and from the standpoint of both safety and appearance, furniture manufacturers are encouraged to provide ready means enabling the installation and removal of all wiring and cables without the necessity of employing a skilled technician or having to partially disassemble a component of the furniture article.

By the present invention an improved grommet assembly is provided which is disposed flush with both the top and an outer edge of the furniture article top member and which comprises a stationary component cooperating with a slidable component, which latter component is longitudinally displaceable to and from the direction of the furniture top outer edge. When the assembly is in its use position a relatively restricted wiring access is provided by the two juxtaposed components, and when it is desired to install or remove a wire through the assembly, the movable component is axially displaced in a plane parallel with the upper surface of the furniture article top such that a substantially enlarged wiring access is provided to enable plugs and other components associated with the wiring to be passed therethrough. An arrangement as described above is particularly desirable when the furniture article is equipped with a partition or panel disposed upon the top upper surface adjacent its outer edge since the instant grommet structure allows of manipulation thereof without the necessity of removing any such front panel or any other component of the furniture article.

Accordingly, one of the primary objects of the present invention is to provide an improved furniture article grommet assembly including a slidable grommet segment normally flushly disposed with respect to both an upper surface and outer edge of a furniture article top and having guide means cooperating with the top permitting of longitudinal displacement relative thereto.

Another object of the present invention is to provide an improved grommet assembly for a furniture article top including a stationary grommet segment flushly disposed within a cut-out in the top and cooperating with a slidable grommet segment and wherein each of the two segments is provided with a partial wiring access cut-out.

Still another object of the present invention is to provide an improved furniture article top grommet assembly flushly disposed within a cut-out in the top and including a pair of grommet segments, each having guide means cooperating with retainer means fixedly disposed within the cut-out.

A further object of the present invention is to provide an improved grommet assembly for a furniture article top including a stationary grommet segment disposed within a cut-out in the top and cooperating with a slidable grommet segment having finger means operable when the slidable segment abuts the stationary segment to retain the two segments in an assembled position.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
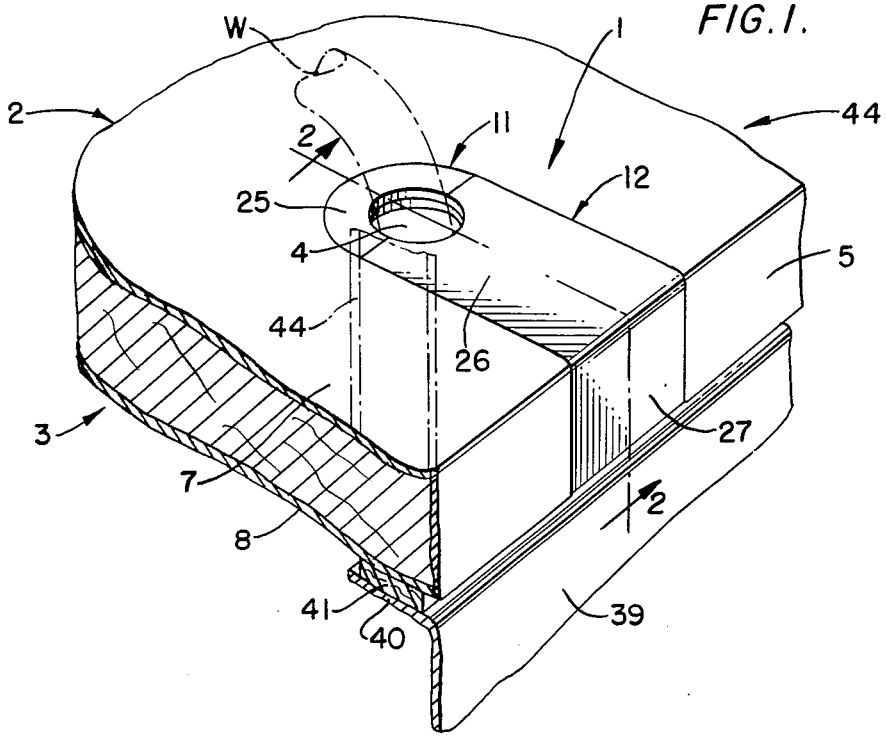
FIG. 1 is a fragmentary top perspective view of a grommet assembly according to the present invention.

Referring now to the drawings, particularly FIG. 1, the present invention will be seen to relate to a grommet assembly, generally designated 1, as applied to the top member 2 of a furniture article 3. The assembly 1 provides the wire opening 4 well spaced from the outer or front edge 5 of the furniture article top 2 and it will be appreciated that the furniture article 3 may comprise any of various types of furniture devices such as a desk, table or the like and although the edge 5 is described as the "customer", or front edge, of a desk or table, it will be apparent that the grommet assembly 1 of the instant invention may be employed adjacent any edge of a planar surface.

The assembly 1 comprises three primary components disposed within a cut-out 6 formed in the top 2 and extending from the upper surface 7 through the lower surface 8 thereof, and which is bounded by the pair of oppositely disposed parallel side walls 9—9 communicating in turn with the curved or semi-circular end wall 10, such that a U-shaped configuration is provided when viewed in plan. The three components comprise a stationary grommet segment generally designated 11, a slidable grommet segment 12 and a retainer plate 13. All three components will be seen to be constructed of metal in the embodiment shown in FIGS. 1–4 of the drawings, while the modification illustrated in FIGS. 5–8 discloses the formation of the two grommet segments 11 and 12 from a synthetic material such as plastic or zinc castings.

The stationary grommet segment 11 is of semi-circular configuration in plan and includes an outer periphery 14 mating in configuration with the general dimensions of the curved end wall 10 of the top cut-out 6. This outer periphery 14 terminates at the two forward edges 15—15 which in turn communicate with a first wiring access cut-out 16 defined by the semi-circular inner periphery 17. Following the initial installation of a furniture article top with the grommet assembly of the present invention, it will be understood that the stationary grommet segment 11 normally remains fixedly disposed in the position shown in FIG. 1 of the drawings, and this component would only need to be subsequently removed should it become damaged or if the user wishes to substitute this segment for one having a first wiring access cut-out 16 of a different dimension. This stationary grommet segment 11 is normally retained in its fixed position by means of a retainer plate 13, which likewise is of generally U-shaped configuration and includes the parallel spaced apart side walls 18—18 joined to the intermediate curved end wall 19.

The vertical extent of the retainer plate 13 encompasses substantially the majority of the height or thickness of the top 2 and the upper edge of the plate is provided with an inturned flange 20 along its entire length, which flange is disposed in a plane spaced downwardly from the top upper surface 7 for reasons which will become apparent hereinafter.

Figure 2:
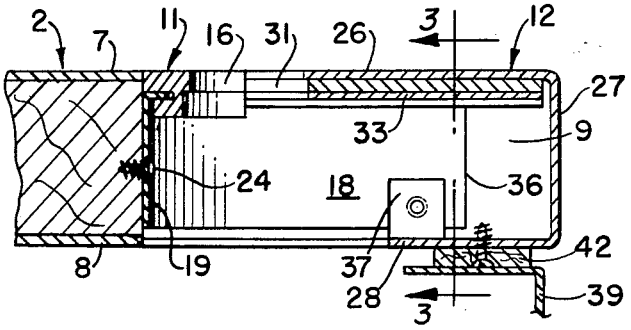
FIG. 2 is a vertical longitudinal sectional view taken along the line 2—2 of FIG. 1.
Figure 4:
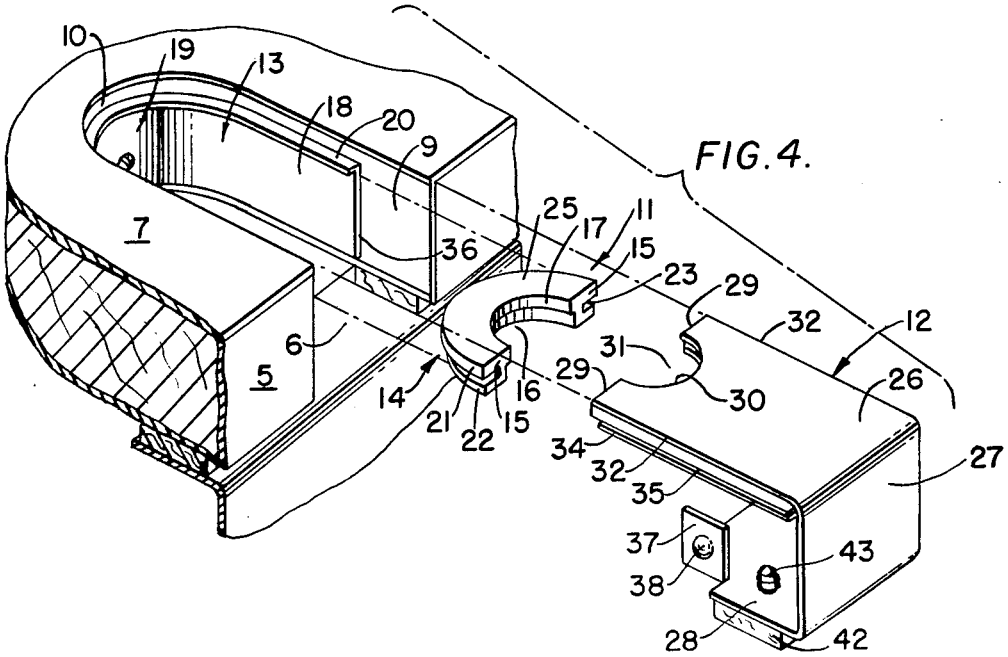
FIG. 4 is an exploded top perspective view of the structure illustrated in FIG. 1 and discloses the two segments of the grommet assembly removed from the furniture article top cut-out.
Figure 5:
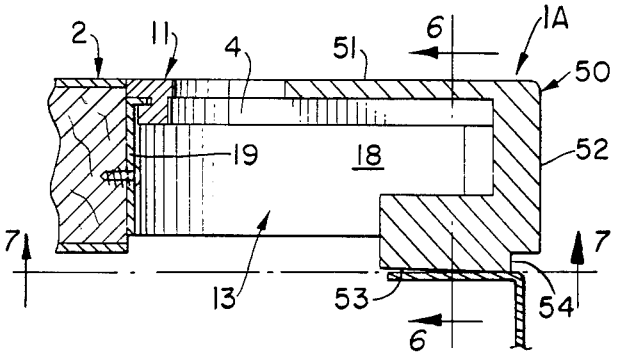
FIG. 5 is a longitudinal sectional view illustrating a modification of the present invention wherein the segments of the grommet assembly are constructed of synthetic material or zinc castings.
Figure 6:
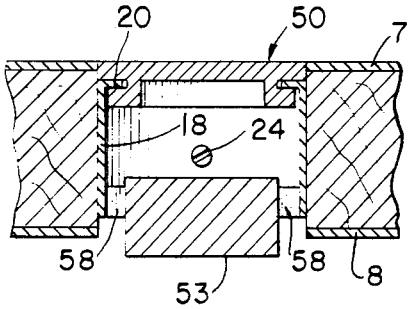
FIG. 6 is a transverse sectional view taken along the line 6—6 of FIG. 5.

The stationary grommet segment 11 is constructed about its outer periphery 14 in a manner to cooperate with the foregoing described cut-out 6 and retainer plate 13 and includes a greater radius upper periphery 21 and a lesser radius lower periphery 22 separated by guide means in the form of the arcuate groove or slot 23. It will be understood that the radius of the lower periphery 22 is intended to mate with the configuration of the curved end wall 19 of the retainer plate 13 while the radius of the upper periphery 21 provides a close mating fit with the configuration of the curved end wall 10 of the top cut-out 6 such that when the stationary grommet segment 11 is installed from the position as shown in FIG. 4 of the drawings to the position as shown in FIGS. 1 and 2, a snug mating fit between the grommet segment 11 and the surrounding structure is achieved with the curved portion of the retainer plate inturned flange 20 providing positive guiding and retention means as it is snugly engaged by the arcuate groove 23 on the grommet segment.

The retainer plate 13 is constructed to provide a snug fit within the top cut-out 6 and is positively anchored therein by suitable means such as the fastener 24 disposed through its end wall 19 and into the material of the furniture top 2. Thus it will follow that with the proper vertical orientation of the retainer plate and its inturned flange 20 during the initial assembly thereof, the planar top wall 25 of the stationary grommet segment 11 will be positively retained in a co-planar relationship with the surrounding upper surface 7 of the furniture article top 2.

Cooperating with the stationary grommet segment 11 to provide the other half of the wiring opening 4 is a slidable grommet segment 12 including a planar top wall 26 disposed normal to a front wall 27 which in turn communicates with the bottom portion 28. The distal portion of the top wall 26 terminates in a pair of rear edges 29—29 between which is formed the semi-circular inner periphery 30 defining a second wiring access cut-out 31. It will be understood that the edges 29—29 and inner periphery 30 of the slidable grommet segment 12 correspond in configuration with the previously described edges 15—15 and inner periphery 17 of the stationary grommet segment 11 such that when the components are assembled as shown in FIG. 1 of the drawings, the respective edges 29 and 15 are flushly juxtaposed and the first and second wiring access cutouts 16 and 31 combine to form a full circular wire opening 4.

The two side edges 32—32 of the top wall 26, front wall 27 and bottom portion 28 of the slidable grommet segment 12 are spaced apart to provide a lateral dimension substantially equal to the width of the opening of the top cut-out 6 as defined between the two side walls 9—9 thereof so that when the grommet segment 12 is in the use position of FIG. 1 of the drawings it will be seen that a close sliding fit is offered in order to provide a flush co-planar relationship between the top wall 26 and upper surface 7 of the top and between the front wall 27 and front edge 5 of the top. Fixedly disposed below the top wall 26 of the segment 12 is a bottom plate 33 having a pair of side flanges 34—34 spaced downwardly and slightly inwardly from the side edges 32 of the top wall 26 so as to provide a pair of longitudinal grooves 35 therebetween. The thus formed grooves 35—35 are disposed in a plane intended to position the upper surface of the top wall 26 in a co-planar relationship with the top upper surface 7 when the retainer plate inturned flanges 20 are disposed within the grooves 35 and it will be apparent that a close fit is desired between the flange 20 and grooves 35. The reason for foreshortening the front edges 36—36 of the two side walls 18 of the retainer plate 13 relative the length of the cut-out side walls 9 will now be apparent since these edges, if extended all the way to the top front edge 5, would preclude the flush disposition of the slidable grommet segment front wall 27 when fully disposed in the use position.

Figure 3:
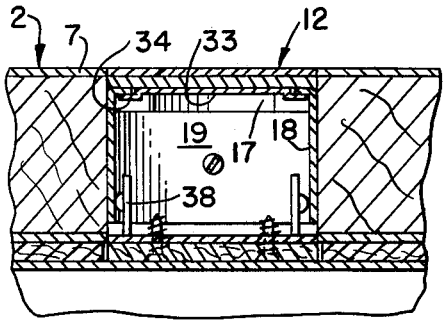
FIG. 3 is a transverse sectional view taken along the line 3—3 of FIG. 2.

Although every effort is made to provide a close mating fit between the various components of the assembly, it is desirable to include additional means to positively insure the retention of the slidable grommet 12 in its use position and accordingly a pair of fingers 37—37 are formed projecting upwardly from the bottom portion 28 and as will be seen most clearly in FIG. 3 of the drawings, are positioned to be located inside the two juxtaposed side walls 18 of the retainer plate 13 when the slidable grommet segment 12 is in its use position. A suitable outwardly projecting embossment 38 is formed on the outer face of each finger 37 and is positioned, during initial fabrication of the segment 12 such that these embossments engage the front edges 36 of the retainer plate 13 during inward movement of the segment to its use position and are subsequently cammed inwardly as they pass the retainer plate front edges 36 and thereafter apply a constant outward pressure against the juxtaposed side walls 18 to firmly retain the slidable grommet segment 12 in the seated position.

The furniture article 3 may include a lower front panel 39 having a top flange 40 juxtaposed the lower surface 8 of the top 2. As is usually the case a cushion strip 41 is disposed intermediate the top flange 40 and top lower surface 8 and this cushion strip may be interrupted in the area immediately beneath the top cut-out 6 and replaced by means of a separate cushion strip 42 suitably attached to the undersurface of the slidable grommet segment bottom portion 28 such as by the fastener 43.

The advantages of the above described grommet assembly 1 are even more appreciated in a furniture article 3 which includes an upper front panel 44 disposed atop the upper surface 7 adjacent the front edge 5. In the past such an installation has often necessitated the temporary removal of either or both the upper front panel 44 and lower front panel 39 in order to install a wire W having an enlarged fixture (not shown) at its end, yet by means of the present arrangement it will be appreciated that the slidable grommet segment 12 is readily axially displaced to substantially enlarge the wire opening 4 without the necessity of disturbing any of the attendant furniture article construction.

The modified grommet assembly 1A illustrated in FIGS. 5–8 of the drawings reflects an adaptation wherein it is desired to construct the stationary grommet segment and slidable grommet segment of a synthetic material such as plastic or zinc castings. In this embodiment the stationary grommet segment 11 is of an identical construction as the metal segment previously described, while the slidable grommet segment, generally designated 50, is of a slightly modified construction although functioning in exactly the same manner as the previously described grommet segment 12.

Figure 7:
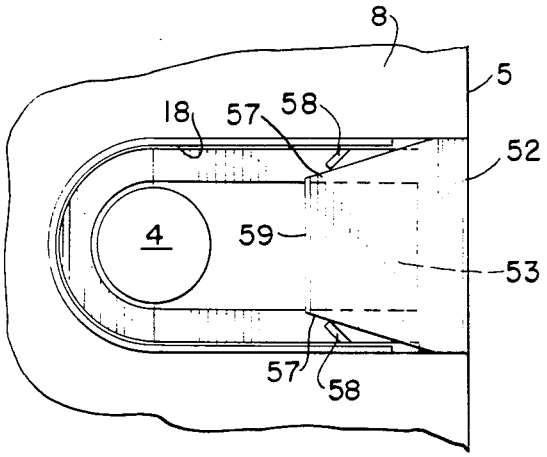
FIG. 7 is a bottom plan view taken along the line 7—7 of FIG. 5.
Figure 8:
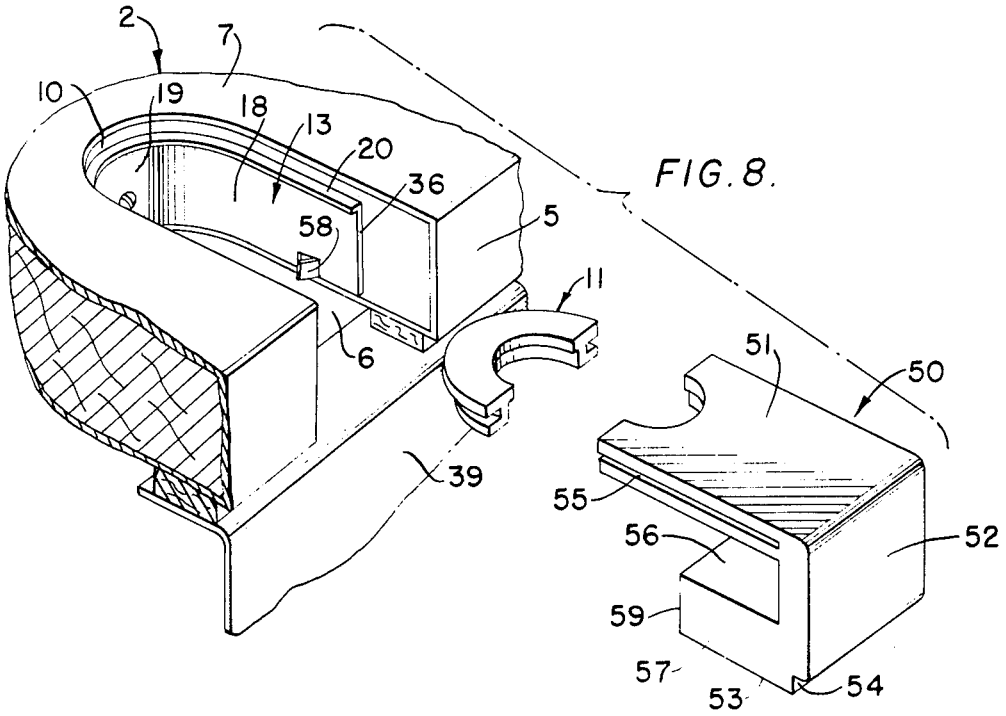
FIG. 8 is an exploded top perspective view of the structure shown in FIGS. 5–7.

The grommet segment 50 is preferably of one-piece construction and includes the top wall 51, front wall 52 and bottom portion 53, which latter portion may include the illustrated inset 54 to simulate the addition of the cushion strip 42 in the first described embodiment. Quite obviously a separate bottom plate beneath the top wall 51 would be dispensed with in this modification and accordingly the lateral grooves 55 may be an integral portion of the grommet segment 50 as it is manufactured. The bottom portion 53 is of substantial height such that its upper surface 56 is disposed in a plane significantly above the bottom of the retainer plate side walls 18 for reasons which will become apparent immediately hereinafter. The two opposite side walls 57—57 of the bottom portion 53 are tapered inwardly from the front wall 52 and are intended to cooperate with a pair of inwardly directed fingers 58—58 extending from the two retainer plate side walls 18. The width of the leading surface 59 of the bottom portion 53 is less than the distance between the free ends of the two fingers 58—58 such that the initial contact between these fingers and the tapered side walls 57 will occur after the leading surface 59 has passed therebetween and immediately prior to the slidable grommet segment 50 reaching its fully seated position as shown in FIG. 7 of the drawings, whereupon a tight wedging engagement is provided by the action of the two inclined fingers 58 upon the inclination of the tapered side walls 57. This frictional engagement is enhanced by forming the inclination of the two fingers 58 at a sharper angle than the inclination of the tapered side walls 57, thus offering a biting action between the free ends of the fingers and the slidable grommet segment.

We claim:

1. A grommet assembly providing a wiring access in a furniture article top having an upper surface, lower surface and outer edge, said top including a cut-out communicating with said outer edge and having an end wall and two side walls, said assembly including a stationary grommet segment within said top cut-out adjacent said end wall and having a first partial wiring access cut-out, a removable grommet segment slidably insertable within said top cut-out into abutment with said stationary grommet segment and having a second partial wiring access cut-out mating with said first partial wiring access cut-out to provide a full wiring access, and mating guide means in said top cut-out and on said removable grommet segment to retain said removable grommet segment in alignment with said stationary grommet segment, said mating guide means including a retainer plate fixedly disposed within said top cut-out and having an inturned flange, and said removable grommet segment includes grooves engageable with said flange.

2. A grommet assembly according to claim 1 wherein, said top cut-out end wall is semi-circular and said side walls parallel one another to define a U-shaped configuration.

3. A grommet assembly according to claim 2 wherein, said retainer plate is U-shaped.

4. A grommet assembly according to claim 1 wherein, said stationary grommet segment includes a peripheral groove engageable with said retainer plate inturned flange.

5. A grommet assembly according to claim 1 including, mating guide means on said stationary grommet segment comprising a peripheral groove engageable with said inturned flange.

6. A grommet assembly according to claim 1 wherein, said stationary grommet segment includes a semi-circular outer periphery mating with said top cut-out end wall and said first partial wiring access cut-out comprises a semi-circular inner periphery on said stationary grommet segment.

7. A grommet assembly according to claim 6 wherein, said second partial wiring access cut-out comprises a semi-circular inner periphery cooperating with said mating first partial wiring access cut-out to define a circular wiring access.

8. A grommet assembly according to claim 1 including, a deflectable friction means engageable within said top cut-out intermediate said top upper and lower surfaces enhancing the retention of said removable grommet segment when in abutment with said stationary grommet segment.

9. A grommet assembly according to claim 8 wherein, said retainer plate includes a pair of spaced apart side walls and said friction means comprises a pair of fingers.

10. A grommet assembly according to claim 9 wherein, said removable grommet segment includes a top wall, parallel bottom portion and connecting front wall, and said fingers carried by said bottom portion and engageable with said retainer plate side walls.

11. A grommet assembly according to claim 9 wherein, said removable grommet segment includes a top wall, parallel bottom portion and connecting front wall, and said fingers carried by said retainer plate side walls and engageable with said removable grommet segment bottom portion.

12. A grommet assembly according to claim 1 wherein, said removable grommet segment includes a top wall and a front wall depending from said top wall, and said top wall and front wall are co-planar with said furniture top upper surface and outer edge respectively, when said removable grommet segment abuts said stationary grommet segment.

13. A grommet assembly according to claim 12 wherein, said stationary grommet segment includes a top wall co-planar with said furniture top upper surface and removable grommet segment top wall.

* * * * *